US005311753A

United States Patent [19]

Kanao

[11] Patent Number: 5,311,753

[45] Date of Patent: May 17, 1994

[54] DRAIN HOSE FOR WASHING MACHINE AND WHICH INCLUDES A CORRUGATED INTERMEDIATE PORTION

[76] Inventor: Shiro Kanao, 9-18, Nanpeidai 4-chome, Takatsuki-shi, Osaka, Japan

[21] Appl. No.: 897,071

[22] Filed: Jun. 11, 1992

[30] Foreign Application Priority Data

Jun. 19, 1991 [JP] Japan ..... 3-54816[U]

[51] Int. Cl.[5] ..... D06F 33/00

[52] U.S. Cl. ..... 68/208; 138/103; 138/118; 138/119; 138/121; 138/122; 138/DIG. 8

[58] Field of Search ..... 138/103, 106, 109, 121, 138/122, 173, 118, 119, DIG. 8, 177; 285/226, 903; 68/208

[56] References Cited

U.S. PATENT DOCUMENTS

| | | | |
|---|---|---|---|
| 3,234,969 | 2/1966 | Du Mont | 138/121 |
| 3,675,448 | 7/1972 | Smith | 68/208 |
| 3,760,430 | 9/1973 | Brenden | 4/323 |
| 3,838,713 | 10/1974 | Tubbs | 138/121 |
| 3,847,184 | 11/1974 | God | 138/121 |
| 3,908,704 | 9/1975 | Clement et al. | 138/121 |
| 3,929,165 | 12/1975 | Diebolt et al. | 138/121 |
| 4,028,746 | 6/1977 | Huck | 4/323 |
| 4,081,190 | 3/1978 | Itzler | 138/121 |
| 4,133,347 | 1/1979 | Mercer | 4/323 |
| 4,151,864 | 5/1979 | Thurman | 138/106 |
| 4,223,702 | 9/1980 | Cook | 4/323 |
| 4,643,229 | 2/1987 | Hickin | 4/323 |
| 4,773,458 | 9/1988 | Touzani | 138/121 |
| 4,846,510 | 7/1989 | Mikol | 138/121 |
| 4,852,564 | 8/1989 | Sheridan et al. | 138/121 |
| 4,921,147 | 5/1990 | Poirier | 138/121 |
| 4,927,191 | 5/1990 | Mikol | 138/121 |
| 4,949,556 | 8/1990 | Knauss | 68/208 |
| 5,023,959 | 6/1991 | Mercer | 138/121 |
| 5,038,586 | 8/1991 | Nukaga et al. | 68/208 |

FOREIGN PATENT DOCUMENTS 61-14992 1/1986 Japan .

*Primary Examiner*—James E. Bryant, III

*Attorney, Agent, or Firm*—Sughrue, Mion, Zinn, Macpeak & Seas

[57] ABSTRACT

A hose continuous in series throughout an entire length integrally formed with a water-intake port, L-shaped bending part, an intermediate part and a drain port in this order from one end of the hose to the other. The substantially general part of the intermediate part is formed with corrugations having inclined side walls of unequal length which are constructed so that shorter inclined walls can be easily brought into their contracted positions substantially parallel to the longer inclined walls and they can self hold their positions. The hose has such a length that the substantially whole length thereof can be housed in an outer casing of a washing machine in its contracted state.

6 Claims, 4 Drawing Sheets

DRAIN HOSE FOR WASHING MACHINE AND WHICH INCLUDES A CORRUGATED INTERMEDIATE PORTION

BACKGROUND OF THE INVENTION

The present invention relates to a drain hose used in and attached to a washing machine.

A conventional washing machine drain hose is generally comprised of two parts, i.e., an internal hose attached to the washing machine and an external hose connected to the internal hose and rested against an outer casing of the washing machine. On the other hand, Japanese Utility Model Unexamined Publication (Kokai) No. Sho 61-14992 discloses a one-piece longer hose continuous in series, which is used in place of the above-mentioned conventional hose comprised of the separate internal and external hoses. The entire one-piece hose is housed inside the outer casing of the washing machine in a snaking manner.

In the former type of the hose having the internal and external hoses, which has been generally known, manufacturing steps are required for the connection of the internal hose and the external hose upon connection to the washing machine. Further, since vibration is caused in use not only in a two-tank type washing machine having a washing tank and a dehydrating tank, but also, particularly in a fully automated washing machine with a washing tank also used for drying, the former type suffers from a problem in that water is apt to easily leak from the connection part of the hoses. For overcoming these problems, the Publication proposes the use of the latter type of longer hose continuous in series, which is adapted to be housed in an outer casing of a washing machine in a snaking manner. However, since this hose is long, it is necessary to form a large space for housing the hose inside the outer casing of the washing machine. When pulling out the hose, it is readily caught on other elements in the washing machine, so that the hose is likely to be damaged. Accordingly, a washing machine itself must be modified in design to solve the problems.

SUMMARY OF THE INVENTION

An object of the present invention is to solve the problems not only mentioned in the former type of the conventional drain hose but also mentioned in the latter type of the drain hose.

Another object of the present invention is to provide a drain hose for a washing machine with an improved structure adaptable to a conventional washing machine designated for the former type drain hose, without modifications of an inner structure of the washing machine.

In order to attain the above-noted and other objects, the present invention provides a drain hose adapted to a washing machine having an outer casing, a drain pipe located inside of the outer casing and a hole formed on the outer casing; the drain hose comprising: a one-piece main body including: an integral water-intake port means at one end of the main body to be connected to the drain pipe; an integral bending part succeeding to the water-intake port means to be bent into an L-shape; an integral drain port means at the other end of the main body to be disposed outside the outer casing through the hole; and an integral intermediate part between the bending part and the drain port means; and wherein the intermediate part is formed with corrugations each having a first inclined wall and a second inclined wall longer in length than the first inclined wall, and each first inclined wall can be easily brought into its contracted position substantially parallel to the respective second inclined wall and can self-hold that contracted position so that the intermediate portion can be completely retracted into an inside of the outer casing through the hole.

In the hose with the above construction, the L-shape bending part succeeding to the water-intake port means may be also formed with corrugations each of which has one inclined wall with length shorter than that of the other inclined wall, like the intermediate part. A main body of the hose may be formed substantially linearly throughout its entire length. The L-shape bending part of the hose may be subjected to bending in an L-shape after the liner hose is formed.

Since the hose for the washing machine according to the present invention is so constructed as mentioned above, the long intermediate part between the drain port means and the L-shape bending part can be largely changed to an extended position and a contracted position and both the positions can be self-held. Therefore, when the hose is not used, the intermediate part except the drain port means in a contracted position can be accommodated substantially linearly in the outer casing of the washing machine. When the hose is used, the arbitrary length of the intermediate part is pulled out through the hole of the outer casing while holding and pulling the drain port means and the drain port means is then inserted into a prescribed drain hole. At this time, the intermediate part is extended correspondingly to the desired length from its contracted position and is maintained to that extended position by itself.

Accordingly, the hose for the washing machine according to the present invention can be used by extending it to any length convenient for use. Further, the hose can be used while being maintained to a substantially horizontal and linear form regardless of the length of the hose thus pulled out. Accordingly, it is not necessary to use the hose in such a manner that the hose is bent upward in an inverted U-shape outside the washing machine as in the former type of the two-part connected hose and that the hose is laid in a snaking manner within the washing machine. Therefore, the hose of the present invention can drain more rapidly and effectively than conventional hoses.

DETAILED DESCRIPTION OF THE PREFERRED EMBODIMENTS

Now, embodiments of the present invention will be described with reference to the accompanying drawings.

Figure 1:
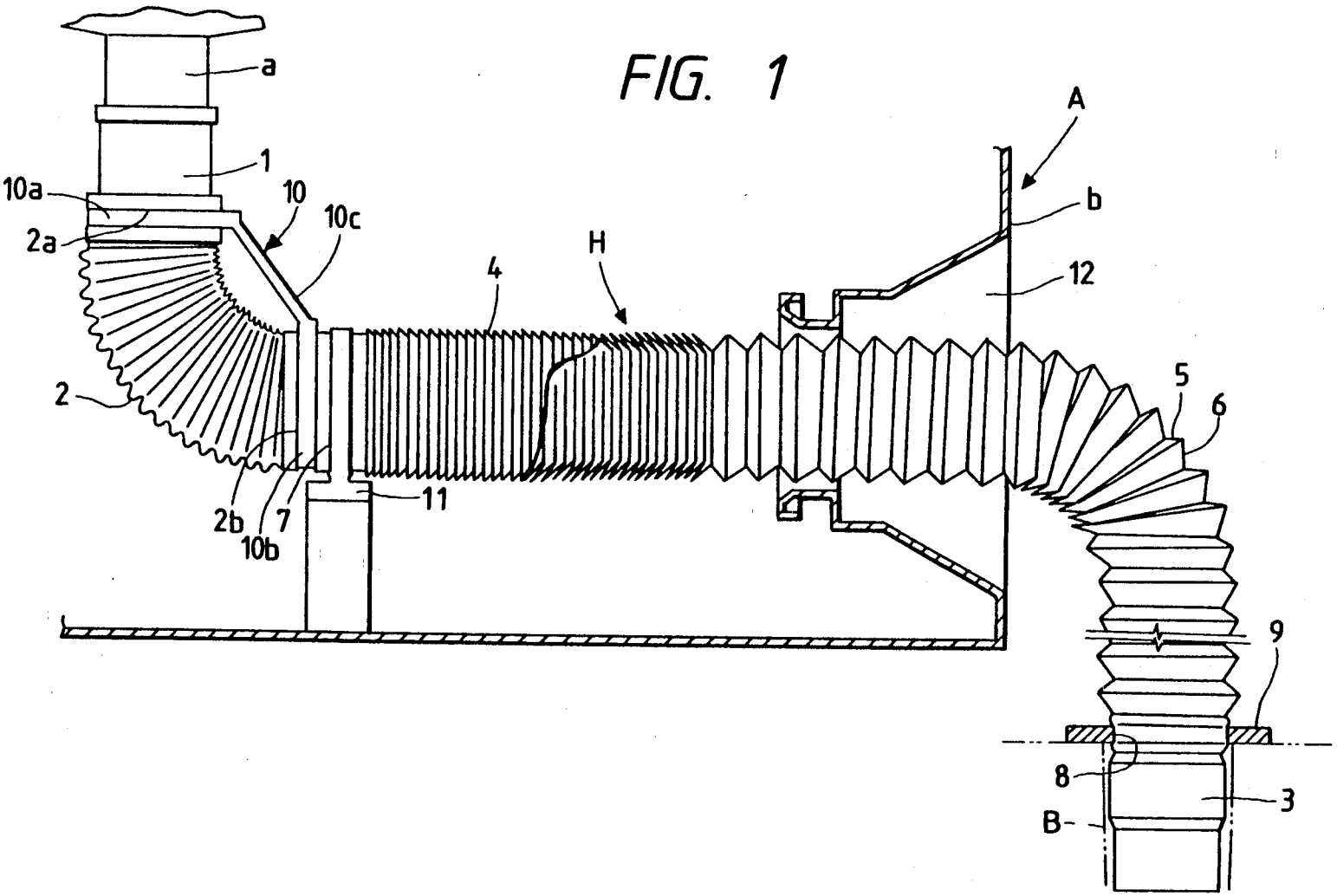
FIG. 1 is a partially fragmentary side view showing a state where a hose according to an embodiment of the present invention is used.
Figure 2:
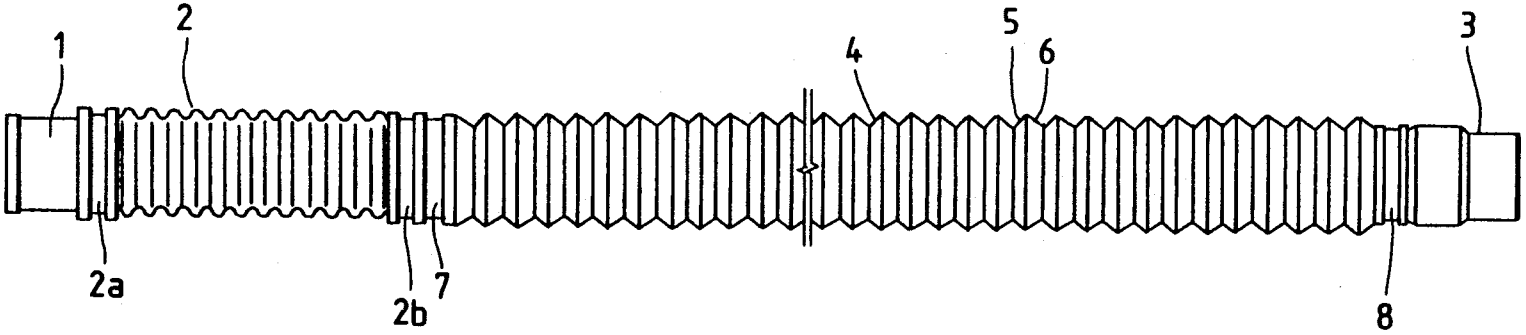
FIG. 2 is a plan view showing the entire portion of the hose with a central part of the hose partially omitted.
Figure 3:
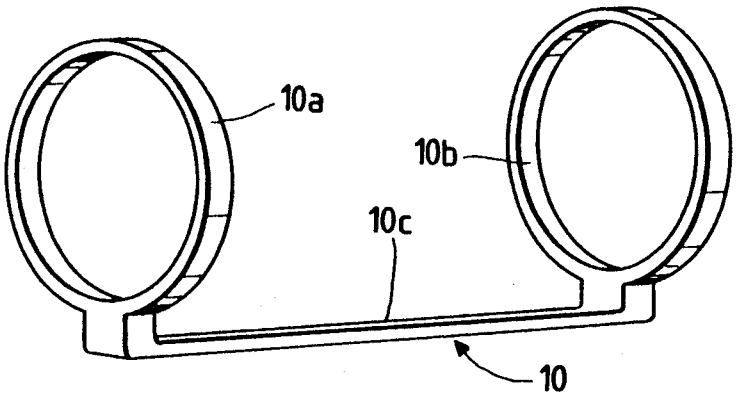
FIG. 3 is a perspective view showing a bending means.
Figure 4:
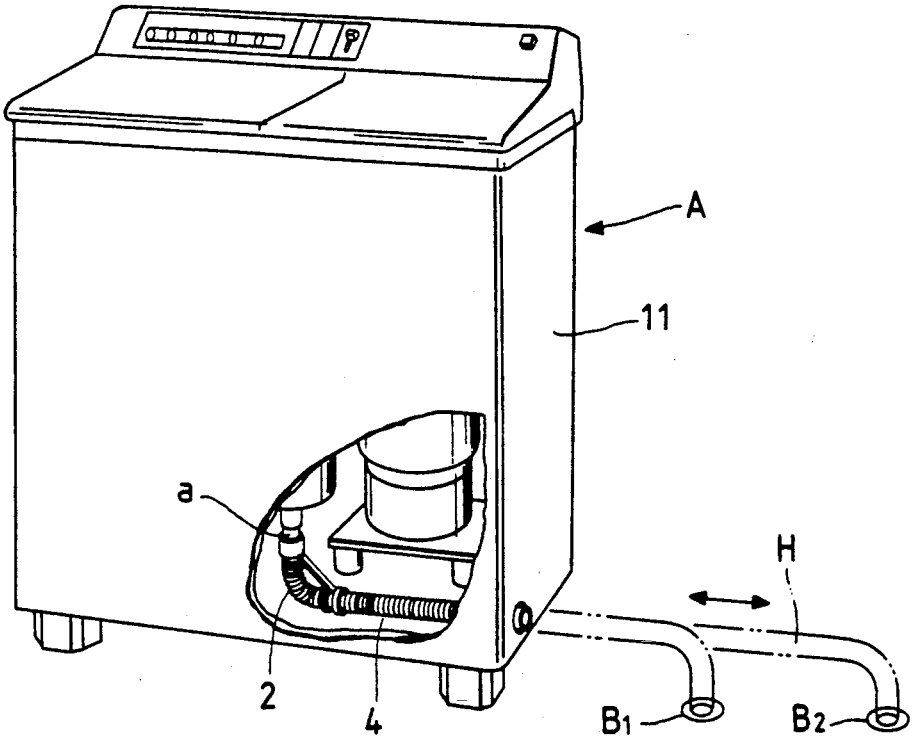
FIG. 4 is a partially fragmentary view showing a state where the hose is mounted in a washing machine.
Figure 5:
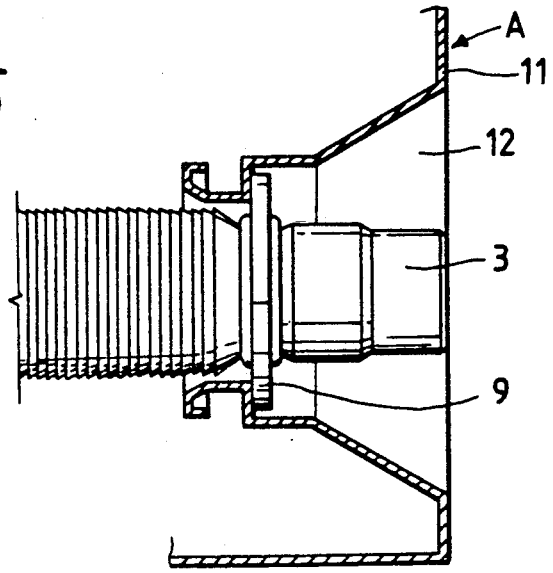
FIG. 5 is an enlarged side view showing a drain port means.

In the drawings, FIGS. 1 to 5 show a first embodiment of the present invention. FIG. 1 shows a main body H of a hose attached to a drain pipe a of a washing machine A under a draining state. FIG. 2 shows an entire form of the main body H of a hose. FIG. 3 shows an L-shape bending means. FIG. 4 shows the hose attached to the washing machine. FIG. 5 shows a view showing the housed state of a drain port means.

A hose for a washing machine according to the present invention is a hose having a part located within a washing machine A and a part located and used at the outside of the washing machine A, as shown in FIGS. 1 and 2, which are successively continuous and formed with synthetic resin material such as polypropylene with a suitably semi-rigid and elastically flexible property. The hose comprises a water-intake port means 1 connected to a drain pipe a of a washing machine at one end side, an L-shape bending part 2 formed in corrugations, in which alternate ridges and recesses are properly formed, and located to succeed to this water-intake port means 1, a drain port means 3 at the other end side and an intermediate part 4 except these parts 1, 2, and 3. The substantially general part of the intermediate part 4 is formed with corrugations each of which has an inclined wall 5 with length shorter than that of the other inclined wall 6. The shorter inclined walls 5 are so formed as to be located at the side of the water-intake port means 1. As can be seen from FIG. 1, the shorter inclined walls 5 can be changed to contracted positions substantially parallel to the longer inclined walls 6 and self-hold their contracted positions. As illustrated in FIG. 4, a main body H of a hose has such a length that the entire length of the intermediate part 4 in the main body H of hose in its contracted position can be accommodated substantially linearly in an outer box b of the washing machine A. As illustrated in FIG. 2, the general part of the main body H of the hose is formed substantially linearly.

FIG. 3 shows an embodiment of a bending means 10 for bending the L-shape bending part 2 in the main body H of the hose formed substantially linearly as mentioned above. The bending means 10, as shown in FIG. 3, has a structure such that two annular bands 10*a*, 10B are connected by means of a connecting part 10*c* of prescribed length. The main body H of the hose has annular grooves 2*a*, 2*b* formed axially at both side positions of the L-shape bending part 2, as shown in FIG. 2. As illustrated in FIG. 1, the annular bands 10*a*, 10*b* are respectively fitted into the annular grooves 2*a*, 2*b* so that the L-shape bending part 2 is bent.

In order to attach the hose having the L-shape bending part 2 bent in this way to the washing machine A, the water-intake port means 1 is inserted into the drain pipe a in the washing machine A. If necessary, the outer peripheral part thereof is clamped by a prescribed clamping means. A fitting part 7 of a supporter is supported by the supporter 11. The intermediate part 4 is brought into a contracted position. As shown in FIG. 5, the drain port means 3 is located at a hole 12 for housing the end of the hose which is formed in the outer box b of the washing machine A. Reference numeral 9 designates a positioning ring fitted to a positioning ring fitting part 8 formed adjacently to the intermediate part 4 side of the drain port means 3. However, the ring 9 is not always required. A similar means may be formed by expanding the wall of the hose itself, if required.

For use of the above-described hose, it is pulled out up to an arbitrary length by holding the drain port means 3 and the drain port means 3 is inserted into a prescribed drain hole B, as shown in FIG. 1. In this case, whether the drain hole B is locate at a position $B_1$ near to the washing machine A or at a position $B_2$ remote from the washing machine A, as indicated by chain lines in FIG. 4, the hose can be pulled out up to a length appropriate for the position and used in a substantially horizontal and linear position.

Although the illustration is omitted because of easy understanding, the corrugations of the L-shape bending part 2 succeeding to the water-intake port means 1 may be formed with corrugations, each of which has one inclined wall 5 with length shorter than that of the other inclined wall 6 similarly to the corrugations of the intermediate part 4.

Figure 6:
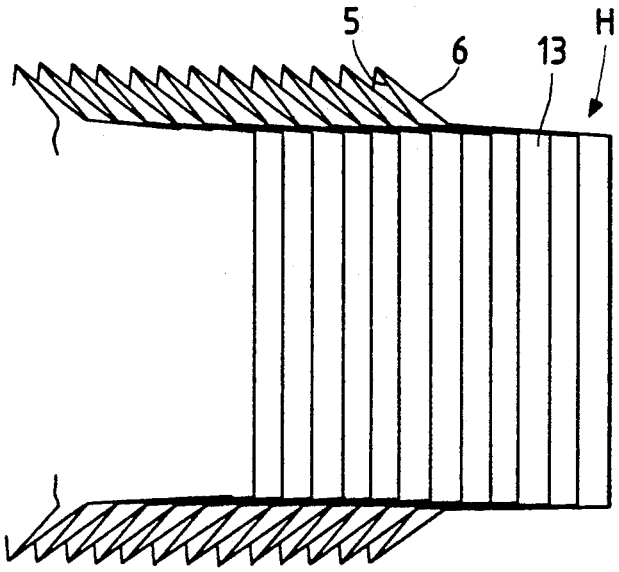
FIG. 6 is a longitudinally sectional view showing an intermediate part of a hose according to another embodiment of the present invention in a contracted position.
Figure 7:
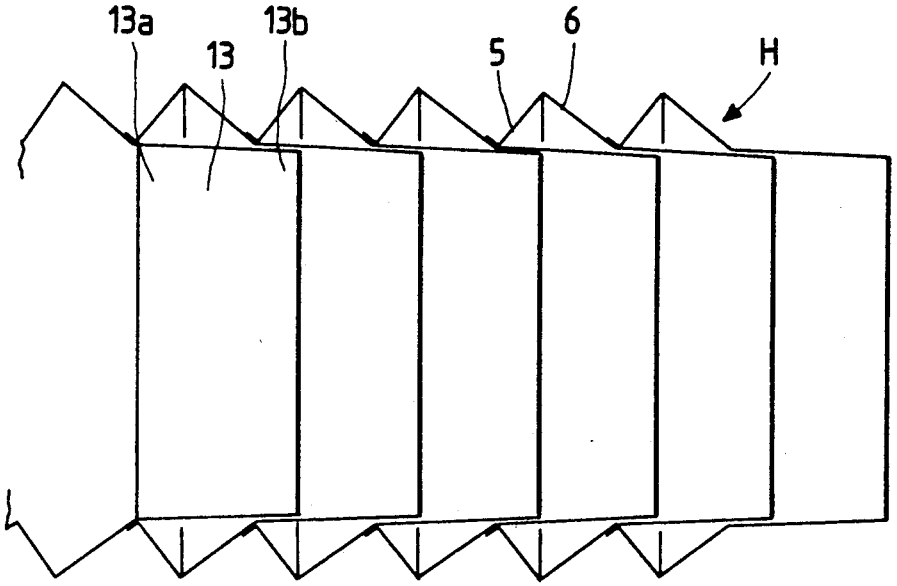
FIG. 7 is a longitudinally sectional view of the intermediate part shown in FIG. 6 in an extended position.

Another embodiment of a structure of a main body H of a hose for a washing machine according to the present invention is shown in FIGS. 6 and 7. As shown in the drawings, a pipe wall of corrugations in the hose comprises the shorter inclined walls 5 and the longer inclined walls 6. An end side 13*a* is preferably connected to an inner peripheral face of each bottom part of the pipe wall and the other end side 13*b* is projected axially of the pipe in a free end with a small diameter so that an inner pipe member 13 may be formed. Although the structure of the pipe shown in the drawings is formed with a band element for connecting the corrugated triangular walls 5, 6 which comprise the pipe wall integrally with the inner pipe members 13, it is possible to use a band element constituting the corrugated triangular wall 5, 6 different from that constituting the inner pipe members 13 and to connect these band elements at their ends.

The hose according to the present invention is preferably made of an elastically flexible material with a proper hardness such as polyethylene, polyvinyl chloride as well as polypropylene exemplified in the first embodiment.

Although, in the above-embodiments, the corrugations are annular in configuration, the corrugations may be formed in spiral corrugations. It will be readily appreciated that one side, for example, a longer side of each of the corrugated triangles is made thicker and the other side is made thinner.

The L-shape bending part 2 in the main body H of the hose according to the present invention may be subjected to a bending work during the formation of the hose. However, in this case, a large and complicated bending machine is required and a three-dimensional and complicated bending work must be performed. Therefore, when the hose as exemplified in the embodiments is manufactured, it is preferable in view of cost to form a linear hose (See FIG. 2) simple and easy in manufacturing of the entire length thereof and to bend the L-shape bending part 2 after the hose is manufactured.

Although the typical embodiments of the present invention were described in the foregoing, the present invention is not to be restricted to the structures of these embodiments, but may be properly modified and embodied such that the object of the present invention is achieved without departing the spirits, effects or essential of the invention.

As explained above, according to the present invention, since a hose for a washing machine comprises a water-intake port means connected to a drain pipe of the washing machine at one end side, an L-shape bending part succeeding thereto, a drain port means at the other end side and an intermediate part except these parts, wherein a substantially general part of the intermediate part is formed with corrugations, each of which has one inclined wall with length shorter than that of the other inclined wall, and the shorter inclined walls can be easily brought into contracted positions substantially parallel to the longer inclined walls and self-hold their contracted and extended positions, the long intermediate part excluding the water-intake port means and the drain port means at both ends and the L-shape bending part can be largely changed to the extended position and the contracted position. Therefore, the length of the hose can be extremely changed, the hose can be successively extended from the contracted position to the extended position, or successively shortened from the extended position to the contracted position. Thus, the hose can be extended and contracted to any length between length with the entire length of the intermediate part contracted and length with the entire length of the intermediate part extended. The length which is usually self-held can be conveniently used.

Since the hose has such a length that the substantially general part of the main body of the hose except the drainport means can be housed in the outer casing of the washing machine under a state where the whole part of the intermediate part is brought into a contracted position, the intermediate part except the drain port means, which is mounted in the washing machine, can be accommodated, while not is use, substantially linearly in the outer casing of the washing machine in a contracted position. Upon use, the hose can be pulled out up to any length proper for use by holding the drain port means and used by inserting the drain port means into a prescribed drain hole. Since the hose can be used in a substantially horizontal and linear utilization position whether the length of extension is long or short. Therefore, the hose of the present invention exhibits a remarkable effect in practice in that draining can be carried out more rapidly and effectively in a minimum distance than a conventional hose such as a hose with two kinds of hoses having an external hose bent upward in an inverted U-shape and a long hose which cannot be extended on contracted and is housed in a snaking manner in the washing machine.

What is claimed is:

1. A drain hose in combination with a washing machine, said washing machine having an outer casing, a drain pipe located at an inside of the outer casing and a hole formed on the outer casing; said drain hose comprising:

a one-piece main body including:

an integral water-intake port at one end of said main body and connected to the drain pipe;

an integral bending part succeeding to said water-intake port and bent into an L-shape;

an integral drain port at the other end of said main body and disposed outside said outer casing through said hole; and an integral intermediate part between said bending part and said drain port, said intermediate part being formed with a plurality of corrugations, each of said corrugations being shaped in cross-section so as to have a first inclined wall and a second inclined wall longer in length than said first inclined wall, said first inclined wall and said second inclined wall being joined together at ends thereof, and said intermediate part having such a length as to be completely accommodated inside said outer casing of said washing machine when in a contracted position, wherein each first inclined wall is easily brought into the contracted position substantially parallel to the respective second inclined wall and is operative to self-hold the contracted position so that said intermediate part is completely retracted into the inside of said outer casing of said washing machine through said hole, and wherein when said intermediate part is completely accommodated inside said outer casing in the contracted position, said drain port of said drain hose remains exposed outside of said outer casing of said washing machine through said hole.

2. The combination according to claim 1, wherein said bending part is formed with a plurality of corrugations, each of said corrugations being shaped in cross-section so as to have one inclined wall with a length shorter than that of a further inclined wall.

3. The combination according to claim 1, further comprising:

means for bending and maintaining said bending part into the L-shape.

4. The combination according to claim 1, wherein said intermediate part includes a plurality of cylindrical inner pipe members provided in series inside said intermediate part, each of which is connected at one end thereof to an inner peripheral face of a respective one of said corrugations and is projected from said one end toward said drain port, each said cylindrical inner pipe member being tapered toward said drain port.

5. The combination according to claim 1, wherein said intermediate part further includes a portion, located within said outer casing of said washing machine, which extends linearly and horizontally.

6. The combination according to claim 1, wherein said bending part and said intermediate part are joined together at a junction, said junction being fixed with respect to said outer casing of said washing machine.

* * * * *